US006582500B1

(12) United States Patent
Ohadi et al.

(10) Patent No.: US 6,582,500 B1
(45) Date of Patent: Jun. 24, 2003

(54) ELECTROHYDRODYNAMIC LIQUID-VAPOR SEPARATOR

(75) Inventors: Michael M Ohadi, Columbia, MD (US); Serguei V. Dessiatoun, Colmar Manor, MD (US); Igor Ivakhnenko, Silver Spring, MD (US)

(73) Assignee: University of Maryland, Riverdale, MD (US)

( * ) Notice: Subject to any disclaimer, the term of this patent is extended or adjusted under 35 U.S.C. 154(b) by 0 days.

(21) Appl. No.: 09/927,213

(22) Filed: Aug. 11, 2001

Related U.S. Application Data

(60) Provisional application No. 60/225,321, filed on Aug. 15, 2000.

(51) Int. Cl.[7] ..... B03C 3/36

(52) U.S. Cl. ..... 96/61; 55/DIG. 38; 96/70; 96/77

(58) Field of Search ..... 96/61, 77, 100, 96/96, 70; 55/DIG. 38

(56) References Cited

U.S. PATENT DOCUMENTS

| | | | | | |
|---|---|---|---|---|---|
| 2,594,805 | A | * | 4/1952 | Rommel | 96/61 |
| 2,763,125 | A | * | 9/1956 | Kadosch et al. | 96/61 X |
| 2,867,285 | A | * | 1/1959 | Wintermute | 96/61 X |
| 3,526,081 | A | * | 9/1970 | Kusters | 96/61 |
| 4,010,011 | A | * | 3/1977 | Reif | 96/61 |
| 4,072,477 | A | * | 2/1978 | Hanson et al. | 55/DIG. 38 |
| 4,390,426 | A | * | 6/1983 | Vicard | 96/61 X |
| 4,496,375 | A | * | 1/1985 | Le Vantine | 96/77 X |
| 4,569,739 | A | | 2/1986 | Klinkowski | 204/180.1 |
| 4,649,703 | A | * | 3/1987 | Dettling et al. | 96/61 X |
| 4,689,951 | A | * | 9/1987 | Polach | 96/61 X |
| 5,693,125 | A | | 12/1997 | Dean | 96/157 |
| 5,885,330 | A | * | 3/1999 | Lee | 96/61 X |
| 6,228,148 | B1 | * | 5/2001 | Aaltonen et al. | 96/61 X |

* cited by examiner

*Primary Examiner*—Richard L. Chiesa
(74) *Attorney, Agent, or Firm*—Daniel E. Kramer

(57) ABSTRACT

A device for separating liquid particles from an entraining gas or vapor stream. The device employs mechanical centrifugal forces to concentrate liquid droplets in a limited space for further extraction from the gas flow using an electrical field and an electrically charged collecting surface whereby the particles are attracted to and deposited on the surface for further extraction by the gas flow without reintrainment of the liquid back into the vapor stream. The device is constructed to provide an area of low gas velocity for removing the liquid from the device.

11 Claims, 3 Drawing Sheets

ELECTROHYDRODYNAMIC LIQUID-VAPOR SEPARATOR

PRIORITY

Applicants claim priority based on their Provisional Patent Application filed Aug. 15, 2000 having Ser. No. 60/225,321.

BACKGROUND

Many types of industrial, commercial and even residential technical processes and apparatuses have vapor or gaseous flow streams in which liquid particles of various sizes are entrained. In some of these, the presence of the liquid particles negatively affects the apparatus longevity, the apparatus efficiency or possibly even human health.

The following paragraphs describe examples of such systems and such processes where the invention described and claimed herein can profitably be employed.

Air compressed by air compressors and subsequently cooled frequently has water particles entrained with the air. In one application the water particles enter tools causing corrosion and bearing damage. Other applications find the water separating in a compressed air reservoir or tank where the pooled water, if not drained, causes corrosion that weakens the tank walls, leading to potential catastrophic failure.

Refrigeration systems employ compressors lubricated by oils that, in varying amounts are always entrained with the compressed refrigerant discharged by the compressor. The oil lost from the compressor, if not replaced, can lead to compressor destruction from lack of lubrication. The oil conveyed through the system also causes loss of heat transfer capability in both the evaporator and the condenser.

Oil return in miscible oil-refrigerant systems is generally reasonably reliable because the viscosity of oil conveyed within the system has been lowered by a solution of the refrigerant into the miscible oil. By contrast, oil return in systems employing an immiscible oil-refrigerant pair is much less reliable because the solubility of the refrigerant in the oil is slight and therefore the oil retains its original higher viscosity making flow much less certain. While the system piping can be designed to provide sufficiently high vapor velocities to achieve reasonably satisfactory oil flow, there is a penalty of higher gas pressure drop resulting in reduced system efficiencies. In such refrigeration systems employing immiscible refrigerant-lubricant pairs, discharge line oil separators having the highest efficiencies provide a definite advantage. Moreover, drops of liquid refrigerant in the inlet of a refrigerant vapor pump or compressor can cause damage to the compressor. Therefore, such damage must be avoided by preventing liquid drops of a refrigerant from entering into the compressor inlet.

Comfort air conditioning systems lower air temperature and thereby cause moisture condensation. Some of the condensed moisture is carried along with the cooled airstream into the cooled space, thereby causing discomfort, damage to fabrics and furniture and damage to sensitive electronic equipment, where these are located within the cooled space.

PRIOR ART

To cope with these problems or other problems arising from liquid carry over in vapor streams, many types and designs of mechanical separators have been designed and many are offered commercially for specific uses. The following types are primarily descriptive of those available for use in refrigeration systems to minimize oil carryover in the compressor discharge stream. Some simply reduce the vapor velocity so that liquid particles settle out. Others swirl the gas to provide at least partial centrifugal separation, some provide baffles to secure separation by impingement, some provide fills or meshes which filter or otherwise trap liquid particles on the meshes or in the mesh interstices. However, all these designs have the fault that very small oil particles and liquid droplets escape through the separator and are carried into the refrigeration piping. Further, no special oil separator designs are suggested or provided for immiscible oil-refrigerant systems.

OBJECTS OF THE INVENTION

Objectives of this invention are focused on enhancing efficiency of liquid particle separation from a flowing vapor stream using electrical forces alone or a combination of electrical forces and centrifugal forces. The electrical forces are variously known as Electrostatic (ES) when applied to static situations and Electrohydrodynamic (EHD) when applied to situations involving their effects on moving fluids and on the solid and liquid particles carried by such moving fluids.

In accordance with a first objective, the invention provides separation of liquid droplets from a vapor/gas flow (or flow stream) by a system of electrically charged electrodes and electrical fields associated with those electrodes.

In accordance with a second objective, the invention provides a liquid/gas separator in which centrifugal forces are used to concentrate liquid drops close to a collecting electrode.

In accordance with a third objective, the invention provides electrical charging of liquid droplets in a gas flow stream by a first electrode.

In accordance with a fourth objective, the invention provides collection of liquid droplets on the surface of a second electrode within the gas flow stream.

In accordance with a fifth objective, the invention provides separation of liquid droplets from a vapor/gas stream by moving liquid droplets collected on the surface of the second electrode along the surface of the electrode from a region of higher vapor velocity to a region of lower vapor velocity.

Thus, the invention combines a mechanical centrifugal concentration of liquid droplets with electrical separation of said liquid droplets from the gas flow combined with removal of the separated particles from a region of higher vapor velocity to a region of lower vapor velocity, thereby minimizing reentrainment of the removed particles into the flow stream.

In accordance with a sixth objective, the invention provides a device for modifying the initially straight vapor flow into a twisted one in order to subject the liquid particles to a centrifugal force whereby the liquid droplets are concentrated close to the surface of the second collecting electrode.

In accordance with a seventh objective, the invention provides the second collecting electrode with an electrical field or potential of a character designed to attract liquid particles charged by the first electrode.

In accordance with a eighth objective, the invention provides a combination of charging and collecting electrodes in series.

Further objectives include providing a highly efficient device for separating liquid particles from a flowing vapor stream.

Providing such a device that is mechanically simple and easy to fabricate.

Providing such a device that employs means for imparting a high electrical potential or charge of a first polarity to the gas stream and the liquid particles entrained with the gas stream.

Providing such a device where the polarity of the electrical potential is uni-polar, that is non-alternating.

Providing such a device where the potential imparting means is substantially adjacent the device inlet.

To provide such a device having charged means of a second polarity for attracting the particles charged with the first polarity.

To provide such a device where the particle attracting means includes a cylindrical flow means having an electrical potential substantially equal to and of opposite polarity to the potential applied to the particles.

To provide such a device including at least two coaxial spaced apart cylindrical flow means.

To provide such a device including seriatim in the vapor flow stream a first electrode having a first polarity for initially charging liquid particles, a second electrode having a second opposite polarity for collecting some particles, a third electrode for charging remaining particles with the second polarity and a fourth electrode having the first polarity for attracting substantially all the remaining particles.

SUMMARY OF THE INVENTION

A device for separating liquid particles from a flowing gas stream, the device comprising seriatim: an inlet for receiving the liquid bearing gas stream, an element positioned in the flow stream bearing a signed electrical charge for charging the gas borne liquid particles, a second element positioned in the flow stream bearing an oppositely signed electric charge for attracting and receiving the liquid particles and conveying said particles out of the gas flow stream.

DETAILED DESCRIPTION OF THE INVENTION

Figure 1:
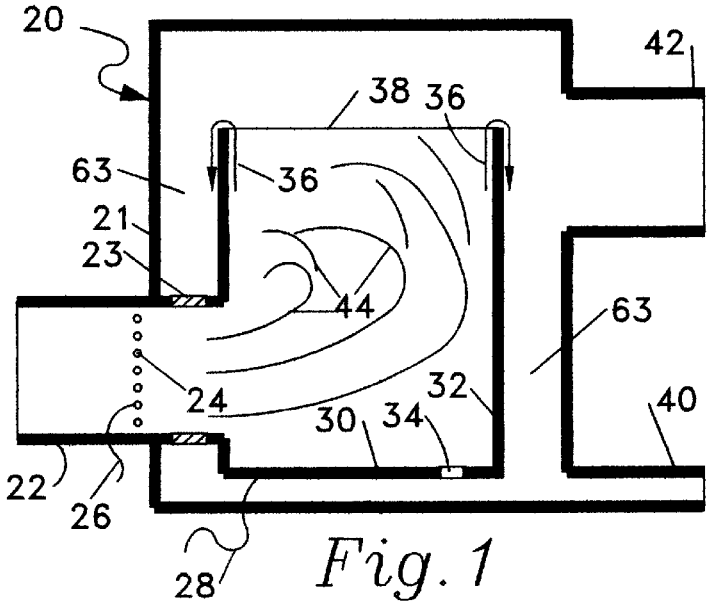
FIG. 1 is a section of an elementary device employing the principle of the invention.

FIG. 1 is a crossection of a simplified device illustrating a principle of the invention. Pairs of components having opposite electrical charges are shown as operative elements. While the charged element most subject to the vapor-liquid mixture entering the separator is generally described herein for convenience as having a negative charge and the collecting element as having the positive charge, it should be understood that reverse polarities may be required for effective operation with other liquids and vapors and that the reversal of electrode polarities is secured simply by interchanging the connecting leads.

Electrohydrodynamic (EHD) separator 20 has an outer metallic shell 21 having an inlet 22 for flow of a mixture of vapor with entrained liquid particles having a range of sizes to be separated. The individual particles are not separately shown in the figures because of their small size. Positioned in the path of the liquid bearing vapor stream entering inlet 22 is an electrical charging element 24 connected to a high voltage source (not shown) by wire or conductor 26 that conveys a negative charge to element 24. The inlet charging element 24 is typically in the form of a metallic screen through which the vapor-liquid mixture must pass. Separator 20 includes a vapor outlet 42 for flow of substantially liquid-free vapor and a liquid outlet 40 for flow of the separated liquid. Within shell 21 there is a more or less centrally positioned metallic collector tube 32 having a bottom closure 30. Collector tube 32 is electrically charged with a high voltage having a polarity equal in potential or voltage but opposite in polarity to the electrical charge applied to inlet charging element 24 by the same high voltage source employed to apply the electrical charge to inlet element 24. The bottom closure 30 has positioned therein at least one orifice 34 to allow liquid separated from the vapor flow stream that flows to the bottom of the collector tube 32 to freely exit collector tube 32 and thereby flow into the bottom of shell 21. Separated liquid reaching the bottom of shell 21 flows to liquid outlet 40 and exits the separator therefrom. Because the vapor velocities within collector tube 32 may be high, it is likely that much of the separated liquid will not flow to the bottom 30 of the collector 32 but instead will be frictionally dragged by the rapidly moving vapor to the upper edge 38 of the collector tube. There, the separated liquid flows over the collector tube edge 38 via flow stream 36 and flows downward by gravity to the exterior bottom 30 of collector tube 32 from which it drops into the bottom of shell 21, thence to liquid connection 40. The vapor flow outlet 42 from the separator 20 is positioned at an upper level of the separator shell 21 thereby assuring substantially zero vapor flow around the exterior of collector tube 32 since a significant vapor velocity around the outside of collector tube 32 would interfere with liquid movement down the exterior of collector tube 32.

Because the collector tube 32 is designed to be electrically charged, it is electrically separated or insulated from the shell 21 and from the separator inlet 22 by insulating connector 23. In another embodiment there is no insulating connector 23 and the shell 21 and collector 32 are at ground potential. In this embodiment, only charging grid 26 is at a high potential with respect to the shell 21, the collector tube 32 and ground.

Within the separator, flow inlet 22 is positioned an electrically charged grid 24 having an electrical connector 26 for connection to a high voltage generator. Collector tube 32 has electrical connection 28 for connection to a second pole of the high voltage generator. Construction of high voltage generators is well known to the electronics art. Examples of direct current high voltage generators are found in color television receivers utilizing cathode ray tubes, in color computer monitors having cathode ray tubes and many other household and commercial appliances. Typically such high voltage generators employ fly-back transformers and high voltage rectifiers but other constructions including high voltage generating transformers such as Tesla coils and static electricity generators are well known.

Typically, a direct current (DC) high voltage generator has terminals of positive and a negative polarity. While the flow inlet electrode 24 will here be specified as being connected to the negative terminal of the HV generator and the collector 32 to the positive terminal, the simplicity of reversing the connections to the generator and thereby the polarities of the terminals indicates that both polarities be tried to determine the most effective for each vapor-liquid combination.

Figure 2D:
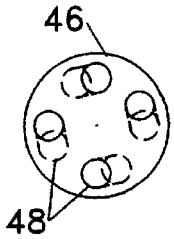
FIG. 2D is a top view of the flow rotating device of FIG. 2C.
Figure 2B:
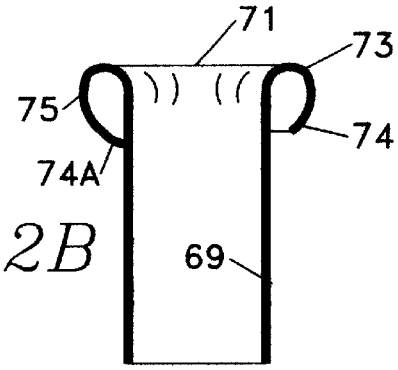
FIG. 2B is a section of a receiving electrode of the device of FIG. 2A showing modifications of the shape of the outlet end.
Figure 2A:
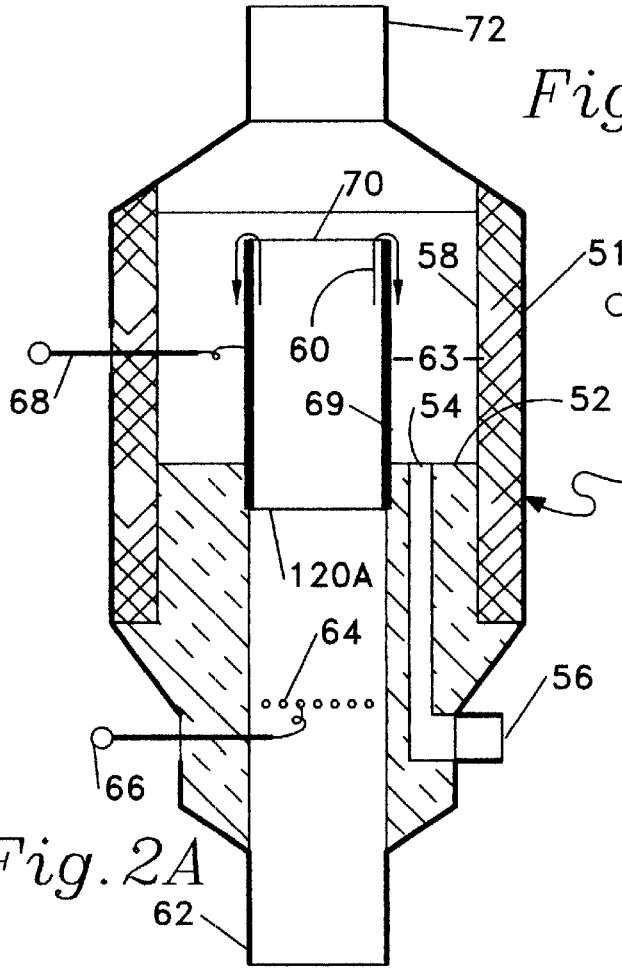
FIG. 2A is a section of a single stage separator of the invention showing details of construction.

In FIG. 2A (with reference to FIG. 5) there is displayed a crossectional view of a practical EHD separator 50 employing principles of the invention. In FIG. 2A separator 50 includes enclosing shell 51 that is most frequently of metallic construction. Typical shell constructional materials include copper and steel. Material selections depend on the temperatures and pressures of the liquid laden vapor entering the separator 50. For refrigeration systems (FIG. 5) employing HCFC-22 and mineral oil, steel is generally the preferred material for separators intended for application in the hot, high pressure discharge line 102 (location D) for removal of oil discharged by the compressor along with the refrigerant vapor. The oil removed by the discharge line separator is then returned to compressor 100. The discharge line conveys the hot gas from compressor 100 to condenser 104 where the vapor is cooled by air circulated by fan 106. The condenser 104 cools and condenses the hot discharge gas to a liquid that is circulated to the evaporator 112 through liquid line 108 and expansion device 110.

Figure 5:
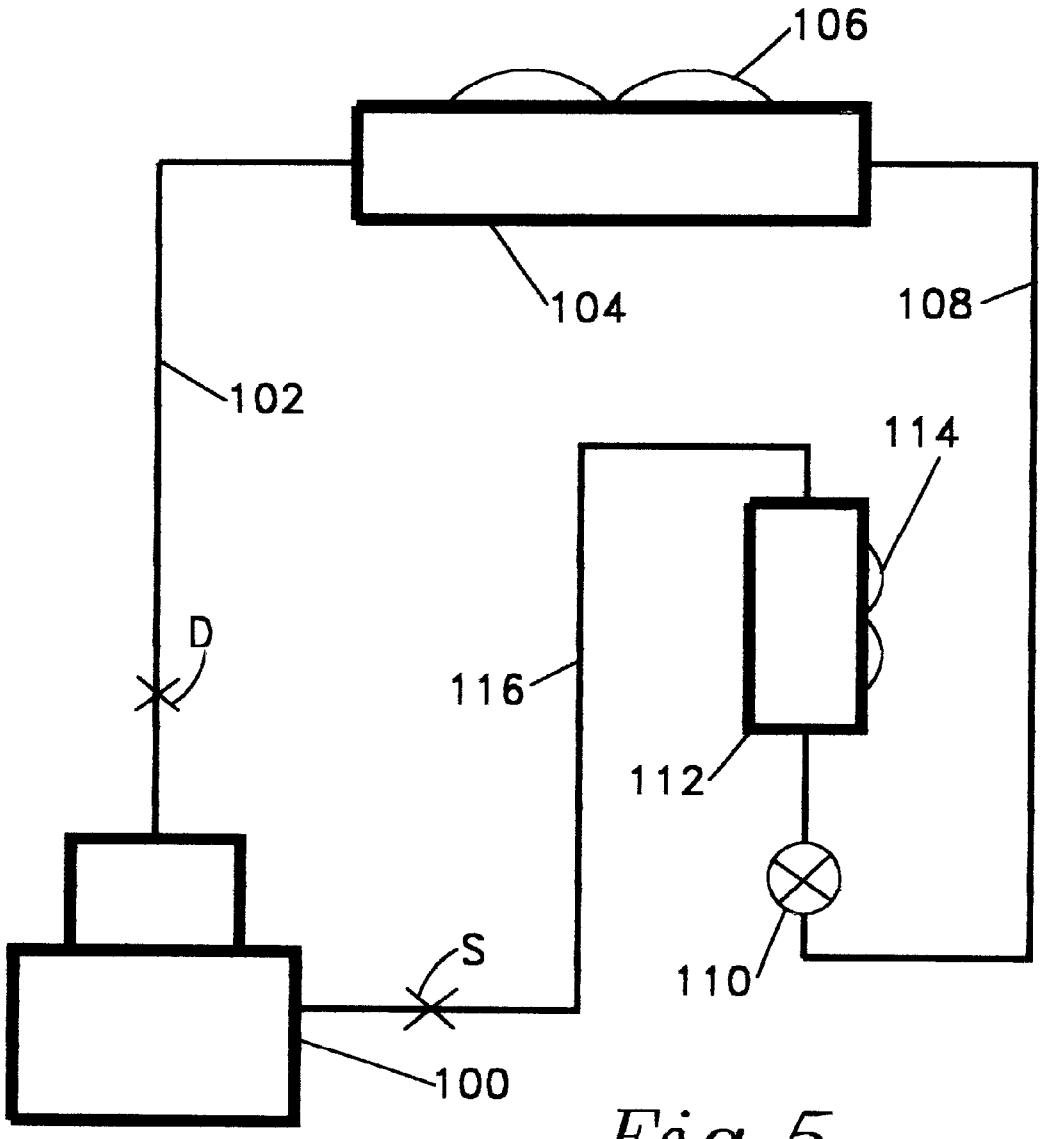
FIG. 5 is a schematic piping diagram of a compression type refrigeration system including identification of specific locations for application of the invention.

At suction location S in FIG. 5, by contrast, copper is the preferred shell 51 material for CFC, HCFC and HFC refrigerants. That is because the low pressure, relatively cold, suction conduit 116 (at location S) is subject to condensation of moisture from the atmosphere. The function of the separator 50 applied at location S is for removal of potentially damaging liquid refrigerant particles attempting to reach the compressor 100. The liquid refrigerant borne by the cold suction stream can be emitted accidentally or intentionally from evaporator 112 over which air is circulated by fan 114 or from other sources.

Continuing reference to FIG. 2A, The collector tube 69 is preferably formed of copper or steel or other highly conductive material.

Figure 2C:
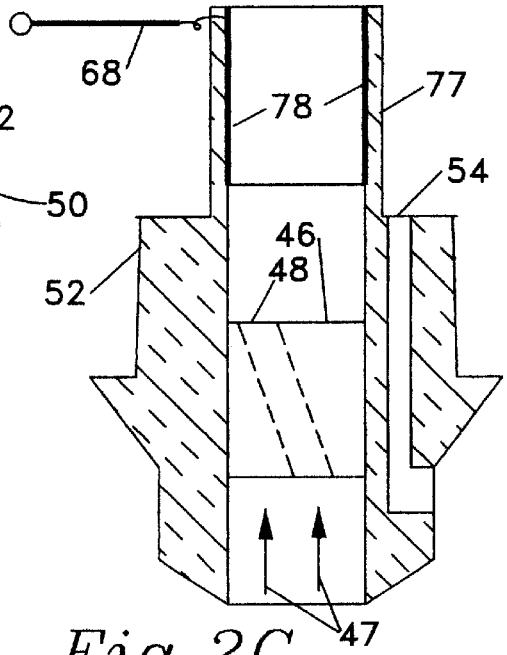
FIG. 2C is a section of a part of the device of FIG. 2A showing all plastic construction with a metallic insert as the secondary collecting electrode and a flow device for producing a rotating flow over the secondary electrode.

A second preferred construction shown in FIG. 2C provides support tube 77 formed of electrically insulating plastic having a conductive coating 78 of copper plated at least on its interior to function as the collector surface.

Inlet fitting 62 is adapted for connection to receive the flow of gas or vapor carrying the liquid particles to be removed by separator 50. Within shell 51 are electrically insulating plastic or resin structures 52 and 58. Both are formed of plastic material suited to the application. For service in a hot compressor discharge line the plastics should be of the thermosetting type or of a thermoplastic type specially designed to be stable under temperature conditions as high as 400F. Alternate supporting materials are ceramics. For relatively cool suction service, ordinary thermoplastics would be satisfactory. In other embodiments, both plastic structures 52 and 58 can be molded in a single piece.

Plastic element 52 performs several functions: It provides an interior flow passage for the vapor-liquid mixture to collector tube 69; It provides mechanical support for the collector tube 69; It provides material within which liquid flow passage 54 is formed for flow of separated liquid to liquid outlet 56 and it provides both an electrically insulating matrix for support of high voltage grid 64 that serves to electrically charge inflowing liquid particles entrained with vapor stream entering flow inlet 62 and it serves to support and electrically insulate conductor 66 that communicates the electrical potential from the external high voltage power supply to the grid 64.

Plastic element 58 serves as electrical insulator and mechanical support and sealant for conductor 68 that communicates an electrical potential, having an opposite polarity from the polarity of grid 64, to the collector tube 69. Flow outlet 72 provides connection means between the separator 50 and vapor flow conduits external of the separator. Flow outlet 72 is positioned to ensure minimum or zero vapor velocity around the outside of collector tube 69.

Liquid particles entrained with vapor entering separator inlet 62, having been electrically charged with a polarity by passage through and contact with high voltage grid 64 are attracted to and deposited on the opposite polarity electrically charged collector tube 69. The collected liquid particles are conveyed upward along the interior of collector tube 69 and flow over the outlet end of tube 69 in path 60 and down the outside periphery of tube 69 to liquid flow outlet conduit 54. Very high vapor velocities within collector tube 69 can cause reentrainment of collected liquid particles at a sharp (small radius) end 70 of tube 69 collected on the interior of collector tube 69.

FIG. 2B shows two modifications in the shape of the outlet end of tube 69. In the right-hand modification, the end 71 has been rolled over into the shape 73 whose edge 74 does not contact the exterior of tube 69. In the left-hand modification the end 71 of tube 69 has been rolled over into shape 75 so that the end 74B of the rolled-over portion contacts the exterior of tube 69. Both these constructions provide a larger radius at the outlet flow end 71 of collecting tube 69 thereby discouraging reentrainment of collected liquid into the vapor stream leaving collecting tube 69.

Separator vapor outlet 72 is positioned so that liquid flowing down the outside of tube 69 does so in volume 63 within which there is essentially no vapor flow. This allows separated liquid to flow unimpeded to the liquid outlet conduit 54.

FIG. 2C illustrates the construction of the collection portion of any version of the separator where the collector support tube 77 is part of the molded plastic construction and the collecting portion comprises a plated conducting layer 78. In FIG. 2C only plastic part 52 is shown. High voltage connection 68 is connected to the metallic interior layer 78 by the connecting electrode and either a mechanical or soldered connection.

The effectiveness of a charged collecting element in attracting and separating oppositely charged entrained liquid particles from a flow stream is strongly related to the proximity of the particles to the collecting element. The disclosed invention employs centrifugal principles to move the liquid particles, desired to be separated from the vapor flow stream, close to the oppositely charged separating element. Referring again to FIGS. 2C and 2D and FIGS. 4A and 4B there is employed a flow rotating element 46 positioned in the flow stream between the initial particle charging element 64 and the oppositely charged collecting element 78 to secure the desired centrifugal effect.

The flow rotating element 46 comprises a cylindrical plug with an axis parallel to the general vapor flow direction. Plug 46 has formed within it one or more conduits or passages 48 positioned or oriented at an angle to the general flow direction 47 to cause rotation of the vapor stream and entrained liquid particles leaving plug 46 and entering collector tube 78. The rotation of the vapor stream creates a centrifugal effect that causes the liquid particles to approach more closely the inner surface of collecting electrode 78.

Figure 3:
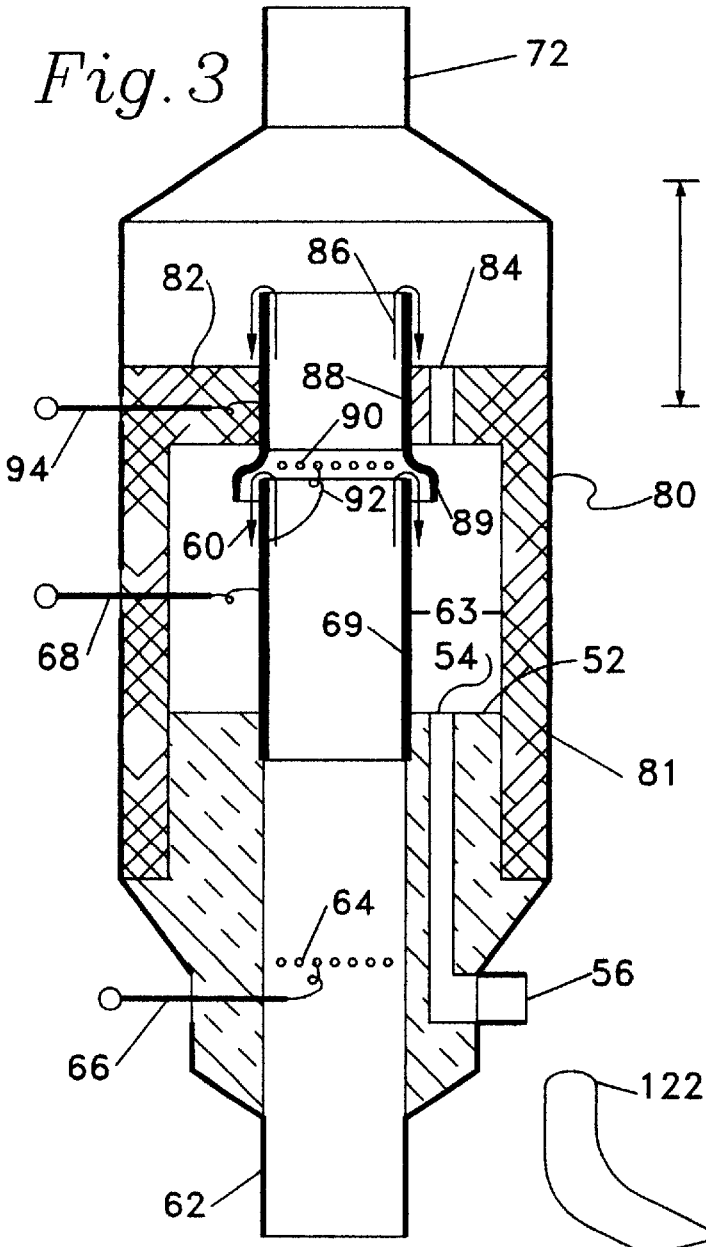
FIG. 3 is a section of a two-stage embodiment of the invention.

In FIG. 3 there is shown a two-stage embodiment 80 of the invention in which the vapor flow, having been partially depleted of its entrained liquid particles, is exposed to a reversed potential whereby the remaining liquid particles are substantially removed. In FIG. 3 the two stage separator 80 has a shell 81 substantially similar to the shell 51 of FIG. 2A except longer. The lower portion of the shell and its interior are substantially identical to the interior construction and operation of the separator 50 of FIG. 2A and the elements have the same numbers for corresponding parts. However, plastic portion 58 of FIG. 2A has been extended and now labeled 82. The element 82 has been provided with a supporting flange portion extended toward the shell axis for supporting a secondary collector tube 88. The collector tube 88 may be a metal tube or a metallic layer 78 applied to the interior of a plastic tube 77. The flange portion of the plastic part 82 has been provided with at least one flow channel 84 for flow of separated liquid. Liquid collected within the secondary collector tube 88 flows over the top edge of the secondary collector tube 88 in flow path 86 and flows to the liquid outlet 56 of the separator through the paths already identified. The lower portion of secondary collector tube 88 is formed into a flared portion so that liquid that flows down the tube 88 on flow stoppage drops into still volume 63 for flow to the separator outlet 56.

Parts expected to have high relative electrical potentials imposed between them, such as tube 88 and both grid 90 and primary collector tube 69 should be separated by a distance sufficient to prevent electrical arc-over. This is especially important when the separator is to be applied in suction line or other very low pressure applications.

In another embodiment of the invention, the secondary collector tube 88 is formed with a larger inside diameter than the primary collector tube 69, thereby providing a lower vapor velocity to facilitate liquid separation. Secondary charged grid 90 is positioned at the outlet of primary collector tube 69 and is connected to the same high voltage source so the secondary grid 90 has the same electrical polarity as primary collector tube 69. Secondary charged grid 90 has the function of restoring a high level of electrical potential to yet unseparated liquid particles leaving primary collector tube 69. Secondary collector tube 88 is electrically connected by connector 94 to the same electrical connection on the high voltage source as connector 66 thereby providing it with an electrical charge highly opposite to the electrical charge imposed on the remaining liquid particle by grid 90.

In other embodiments, the connection to grid 90 is made to the same polarity electrical supply as inlet grid 64 and the connection to secondary collector tube 88 is made to the same polarity as the primary collector tube 69.

In another embodiment of the invention, secondary collector 88 is connected to a potential source that generates a greater potential difference between the grid 90 and collector 88 than the potential between the primary grid 64 and the primary collector 69.

Figure 4B:
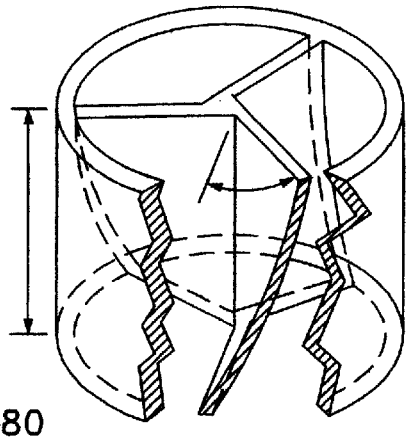
FIGS. 4A, 4B and 4C show three constructions of a flow rotating device.
Figure 4A:
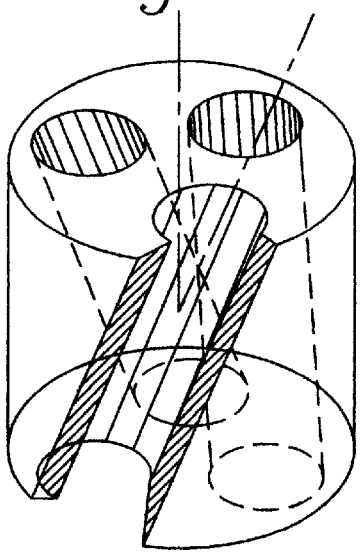

Referring to FIG. 4A there is shown for improved clarity an isometric, partly cut away, view of the vapor rotating element 46 shown in FIGS. 2C and 2D. Inclined angled flow passages 48 are formed at an angle 49 with the primary flow direction at the flow inlet of element 46. While the passages 48 are shown straight, they may be formed with increasing angle to the direction of the primary flow direction.

FIG. 4B illustrates a second embodiment of the flow rotating element identified here as 96. Vanes 99 are provided at an angle 96 to the flow direction at the inlet of the device. While the vanes 99 are shown formed with curvature, in other embodiments, they are formed at a fixed angle to the general flow direction 47.

Figure 4C:
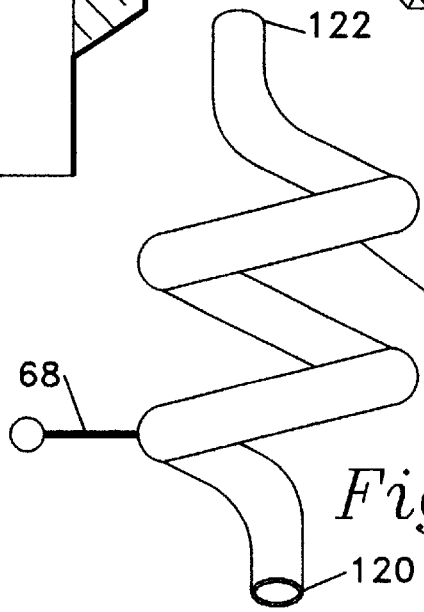

FIG. 4C illustrates an alternate embodiment of the invention employing a spiral collecting tube that combines the collecting function as an electrically charged tube having a charge opposite that supplied to the liquid particles by inlet electrode 64 and a swirl device for generating a centrifugal force on the particles to be separated, thereby forcing them into closer proximity to the charged collecting element. The spiral charged collecting tube 118 has inlet 120 that is positioned at 120A (FIG. 2A) in this alternate embodiment. The outlet 122 of the spiral collecting tube 118 functions just like outlet 70 of straight collecting tube 69 (FIG. 2A) emitting the substantially particle-free vapor for flow to separator outlet 72 and allowing the flow of the separated liquid over the edge of the outlet 122 and down the exterior, in a volume 63 having substantially zero vapor velocity.

While the vapor velocity in the collector tube depends on the refrigerant type and operating condition, typical dimensions (FIG. 1) for a 12,000 Btu/hr system employing R-134a are:

Inlet and outlet fittings 22,42; 0.75 in. inside diameter. Collector tube 32, 1.25 inches inside diameter; 4 inches length;

Potential difference between primary electrode 24 and collecting electrode 32; 5 to 20 or more kilovolts.

Referring again to FIGS. 2A, 2C and 4A, for the same system and refrigerant, the inside diameter of inlet 62 and collector 69 is 0.74 inches; the length of collector tube 69 is 6 inches. The inside diameter of the angled swirl producing conduits 48 is 0.38 inches.

While the drawings and related text disclose that the interior of the charged collector tube 69 acts as the collecting surface, in other embodiments, the liquid bearing flow stream is directed over the exterior surface of collector tube 69 and the collected oil flows over the top 70 of the collector tube 69 into the interior of tube 69 from which it is drained away.

From the foregoing description, it can be seen that the present invention comprises an advanced liquid-gas separator employing both electrohydrodynamic principles and centrifugal separation principles useable in refrigeration systems, in separators for liquid water from air, from oil in engine exhausts and for other purposes. It will be appreciated by those skilled in the art that changes could be made to the embodiments described in the foregoing description without departing from the broad inventive concept thereof. It is understood, therefore, that this invention is not limited to the particular embodiment or embodiments disclosed, but is intended to cover all elements and modifications and equivalents thereof which are within the scope and spirit of the invention as defined by the appended claims and this disclosure.

We claim:

1. A device for separating liquid particles from a flowing gas stream, the device comprising seriatim: an inlet for receiving the liquid bearing gas flow stream mixture, a first element positioned in the flow stream bearing a signed electrical charge for charging the gas borne liquid particles, a second element, positioned in the flow stream for attracting and collecting said liquid particles, said second element having a tubular collecting surface bearing an oppositely signed electric charge, and further providing means integral with the second element for inducing a rotating gas and liquid motion within the second element.

2. A device for separating liquid particles from a flowing gas stream as recited in claim 1 further providing that the means integral with the second element for inducing a rotating gas stream comprises an angled gas flow channel.

3. A device as recited in claim 1, further providing that the inducing means comprises a spiral shaped second element.

4. A device as recited in claim 1 where the second element is in the form of a spiral tube.

5. A device for separating liquid particles from a flowing gas stream, the device comprising seriatim: an inlet for receiving the liquid bearing gas flow stream mixture, a first element positioned in the flow stream bearing a signed electrical charge for charging the gas borne liquid particles, a second element bearing an oppositely signed electric charge, said second element having a tubular shape with inner and outer cylindrical surfaces and an outlet end, the inner surface being positioned in the flow stream for attracting and collecting said liquid particles, and means for conveying said collected particles from the inner cylindrical surface to the outer cylindrical surface, said conveying means comprising a rolled-over outlet end of the cylindrical collecting surfaces, whereby collected liquid only is transferred over the rolled-over outlet end of the second element from the inner surface flow side to the outer surface non-flow side of the second element.

6. A device for separating liquid particles from a flowing vapor stream as recited in claim 5, further providing that the rolled-over outlet end has a substantially elliptical cross-section and is substantially fully rolled over so that the rolled over outlet end of the second element contacts the outer cylindrical surface of the second element.

7. A device for separating liquid particles from a flowing gas stream, the device comprising seriatim: an inlet for receiving the liquid bearing gas flow stream mixture, a first element positioned in the flow stream, said first element bearing a first signed electrical charge for charging the gas borne liquid particles, a second element comprising a tube bearing an electrical charge of opposite sign from the first electrical charge positioned in the flow stream for attracting and collecting said liquid particles, means for conveying out of the flow stream liquid particles collected on the second element, said conveying means comprising a rolled-over end of the second element, a third element bearing a third signed electrical charge positioned in the flow stream leaving the second element for charging any gas borne liquid particles not separated in the second element, and a fourth element comprising a tube bearing an electrical charge of opposite sign to the third electrical charge for attracting and collecting the uncollected liquid particles, and means for conveying out of the flow stream said particles collected on the fourth element, said conveying means comprising a rolled-over end of the fourth element.

8. A device as recited in claim 7 further providing means integral with the second element for generating a rotating motion of the gas and liquid particle mixture within the second element.

9. A device as recited in claim 7 further providing means integral with the fourth element for generating a rotating motion of the gas and liquid particle mixture within the fourth element.

10. A device as recited in claim 7 where the electrical charge on the third element has the same sign as the electrical charge on the first element.

11. A device as recited in claim 7 where the electrical charge on the third element has the same sign as the charge on the second element.

* * * * *